US005495631A

United States Patent [19]

Connor et al.

[11] Patent Number: 5,495,631

[45] Date of Patent: Mar. 5, 1996

[54] BRIDGE MODULE

[75] Inventors: Richard C. Connor; Keith J. Mitchell, both of Barton on Sea, United Kingdom

[73] Assignee: The Secretary of State for Defence in Her Britannic Majesty's Government of the United Kingdom of Great Britain and Northern Ireland, London, England

[21] Appl. No.: 318,713

[22] PCT Filed: Apr. 2, 1993

[86] PCT No.: PCT/GB93/00704

§ 371 Date: Oct. 12, 1994

§ 102(e) Date: Oct. 12, 1994

[87] PCT Pub. No.: WO93/21390

PCT Pub. Date: Oct. 28, 1993

[30] Foreign Application Priority Data

Apr. 15, 1992 [GB] United Kingdom ..... 9208291

[51] Int. Cl.[6] ..... F01D 15/14

[52] U.S. Cl. ..... 14/2.6; 14/27; 14/77.1; 14/2.5

[58] Field of Search ..... 14/2.4, 2.5, 2.6, 14/27, 77.1, 73; 404/34, 40, 51, 53, 54

[56] References Cited

U.S. PATENT DOCUMENTS

| | | | |
|---|---|---|---|
| 3,411,167 | 11/1968 | Sedlacek | 14/2.4 |
| 3,499,179 | 3/1970 | Weld | 14/27 |
| 3,504,389 | 4/1970 | Longbottom | 14/27 |
| 4,355,431 | 10/1982 | Diefendahl et al. | 14/27 |
| 4,520,523 | 6/1985 | Fitzgerald-Smith et al. | 14/2.5 |
| 4,825,492 | 5/1989 | Zehavi et al. | 14/1 |

*Primary Examiner*—Ramon S. Britts
*Assistant Examiner*—James A. Lisehora
*Attorney, Agent, or Firm*—Nixon & Vanderhye

[57] ABSTRACT

A module for constructing a modular bridge suitable for use in both a dry span and a floating role comprising a buoyant structure having interconnection apparatus for connecting the module end to end to an adjacent similar module to form a bridge and having one or more link members which are releasably securable to the underside of the bridge module by link securing apparatus. Each link is provided at one end with a double limb connection member and at the other with a complementary single limb connection member, both provided with holes for insertion of a pin to connect two links from adjacent bridge modules together. The releasably securable link members are removed from a bridge assembled for a floating role to reduce redundant weight.

22 Claims, 4 Drawing Sheets

50
60
48
58
46
54
2
9
40

50
60
48
2
9
58
1
C
C
46
52
46
4

48
50
64
2
9
1
4
4
1
58
9
2
64
62
52
40

BRIDGE MODULE

BACKGROUND OF THE INVENTION

1. Field of the Invention

The present invention relates to modules for constructing modular bridges which are designed to be used in both a dry span role and as floating bridges.

2. Discussion of Prior Art

Where there is a requirement to transport a bridge to a particular location and construct it in a short time such as in military operations or in response to a civil disaster modular bridges comprising interconnectable modules are often used. In order to increase the versatility of such bridges they are sometimes designed to be used either in a dry span role or alternatively as floating bridges. Such a design has the added advantage that the bridge can also be used as a ferry. An example of such a bridge is referred to at page 110 of Jane's Military Vehicles and Logistics 1991. As the bridge must have sufficient flexural rigidity when used in the dry span role there is a certain amount of structural redundancy when the bridge is used as a floating bridge or ferry as the natural buoyancy of the bridge supports the majority of the weight of the bridge and any payload borne by the bridge. The consequence of this redundancy is that the weight of the bridge is unnecessarily high when the bridge is afloat and the load that the bridge can support; when afloat is accordingly reduced.

SUMMARY OF THE INVENTION

The object of the invention is to provide a module for a modular bridge which can be used to build a bridge for use in the dry span role or alternatively as a floating bridge and which does not suffer from the disadvantage described above.

Thus according to the invention there is provided a bridge module comprising a buoyant structure with at least one end having module interconnection means for connecting the module end to end to an adjacent module so as to form a bridge comprising a plurality of said modules the module further comprising at least; one link member with link connection means and link securing means the or each link member being releasably securable to the buoyant structure by the link securing means and being longitudinally connectable to a link member of an adjacent module via the link connection means to support tensile forces experienced by a bridge comprising a plurality of said modules.

A bridge can be constructed from bridge modules made according to the invention which can have a high load carrying capacity in the dry span role and yet not suffer from having unnecessary weight caused by redundant strength when used as a floating bridge due to the fact that the link members can be removed in such circumstances.

In order to maximise the load carrying capacity of a bridge module including a link member having a particular stiffness the or each link member is preferably connectable to the module adjacent a lower surface of the module so as to increase the second moment of area of the cross section of the module.

In order to reduce the tendency of a bridge module to twist when loaded eccentrically a link member is preferably provided on each side of the module.

So as to facilitate assembly of a plurality of modules into a bridge structure interconnection of two modules preferably aligns the link connection means of the link members of the interconnected modules.

In order that a single design of link may be used throughout a bridge structure preferably each link has differing first and second ends constituting the link connection means the first end of a link being complimentarily connectable to the second end of a similar link.

In order to facilitate construction of a bridge for use in the dry span role the link connection means is preferably configured so that connection may be effected by horizontal insertion of a single pin from a side of the module.

In order to facilitate removal of the or each link member from the module the securing means for releasably securing the or each link member to the buoyant structure preferably comprises a pinned connection.

In order to safely secure each link member to the buoyant body in a manner which is not likely to interfere with anything passing below the bridge the link securing means preferably includes two upstand members which are accommodated in recesses in the buoyant structure where they may be secured.

In order to reduce the weight of and the number of components incorporated in a module the buoyant structure preferably includes a block which constitutes part of the module interconnection means and also has a recess for accommodating a link upstand member.

In order that link members in a bridge constructed using modules made according to the invention attract a high proportion of the tensile forces experienced by the modules at an early stage of bridge loading the modulus of elasticity of material constituting a majority of the or each link member is preferably more than twice that of material constituting a majority of the buoyant structure.

Materials having a suitably high modulus of elasticity for manufacturing the links from include an alloy containing ferrous material and fibre reinforced plastics material. When the link member is made from reinforced plastics material it preferably has an end connection made from metal.

A suitably strong and robust material for fabricating the buoyant module from is aluminum or an alloy thereof. A lightweight module made from such a material provides the potential for structures which can be hand built and which are easily portable by air.

In order to facilitate the launching of a bridge fabricated from a plurality of modules over rollers the or each link preferably projects below a lower surface of the buoyant structure and has a substantially projection-free underside. The advantage of supporting such a bridge by means of the link members running over support rollers is that the presence of the link members can be ensured when the bridge is being launched over a dry gap. This will prevent launching of the bridge for use in the dry span role with the link members inadvertently omitted.

The invention provides in its second aspect a modular bridge comprising a plurality of modules as described above interconnected with link members of adjacent modules connected via the link connection means.

The invention provides in its third aspect a method of launching a bridge as described above including the step of rolling the bridge over a support structure configured to support the bridge by means of the link members.

BRIEF DESCRIPTION OF THE DRAWINGS

The invention will now be described by way of example only with reference to FIGS. 1 to 9 in which;

FIG. 1 shows a bridge module 1 constructed according to the invention, The basis of the module is a box like buoyant structure 32 of aluminum alloy (having a modulus of elasticity in the order of $71\times10^3$ MPa), Each end 23 of the module which is designed to be connected to another module is provided with a spigot 6 near one top corner and a socket 8 adjacent its other top corner which is dimensioned to receive a spigot 6 of an adjacent module, Each spigot 6 has a horizontal hole in it to accommodate a socket pin 37 which can be passed through an interengaged socket and spigot, Spigots 6 and sockets 8 on opposing sides 23 of the module shown in FIG. 1 can be seen. Below each spigot 6 a tapered lug 10 is provided with a vertical lug hole 11. Adjacent to each socket 8 the buoyant structure 32 is provided with a vertical comer recess 3 containing a housing block 13, The housing block has a first slot 12 in its upper portion which is tapered complimentarily with lug 10 and is provided with a captive pin 14 which can be lowered into the housing to engage a lug 10 of an interengaged module, Running along each end of the under surface of the module is a link 4 which is shown in detail in FIGS. 2 and 3. Each link is connected to the buoyant structure 32 by means of link securing pins 24 which pass through link ups rand members 17 and 21 of the link. The link ups rand member 17 at one end of the link 4 is retained in a recess 15 in the lower portion of the housing block 13. The link ups rand member 21 at the other end of the link is retained in a recess 19 in the buoyant structure 32. At one end of each link a steel single limb connection member 16 is provided and at the opposite end of the link a steel double limb connection member 18 is provided. The connection members 16 and 18 are configured such that a single limb connection member 16 on one link can pass between the limbs of a double limb connection member 18 of another link. Each limb is provided with a hole 20 so that a link connecting pin 22 (see FIG. 3) can be passed through a pair of engaged connection members 16 and 18 in order to connect two links together. The links at each end of the module face in opposite directions so that each end face 23 of a module which is adapted for connection to an adjacent module presents a double limb connection member 18 at one side of its lower edge and a single limb connection member 16 at the opposite side of its lower edge.

The construction of a link member 4 is shown in FIGS. 2 and 3. FIG. 2 is a vertical section on the line AA through the module shown in FIG. 1 and FIG. 3 is a horizontal section on the line BB of the link member 4 shown in FIG. 2. The link comprises a central portion 26 of carbon fibre reinforced plastics material (having a modulus of elasticity in the region of $200\times10^3$ MPa) with the fibres aligned to run longitudinally along the length of the link. Glued into each end of the central portion 26 is a stepped portion 28 of a link connection member 16 or 18. In addition to being glued in place each connection member 16 or 18 is secured to the central portion. 26 by clamping pins 30 which pass through both the central portion 26 and a connection member.

The entire link member may alternatively be fabricated from steel having a modulus of elasticity in the order of $190\times10^3$ MPa.

Figure 1:
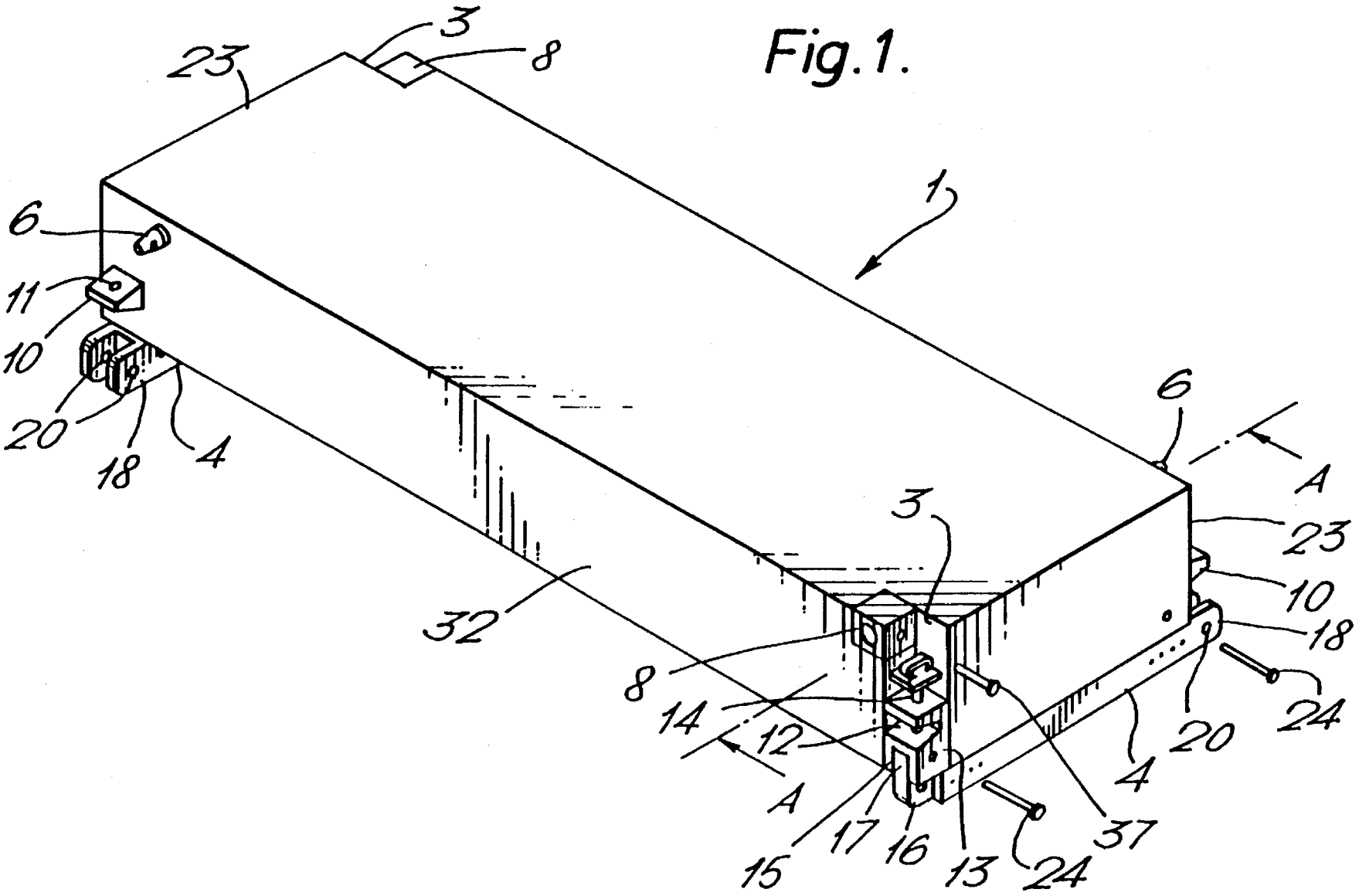
FIG. 1 shows a perspective view of a bridge module constructed in accordance with the first aspect of the invention.
Figure 2:
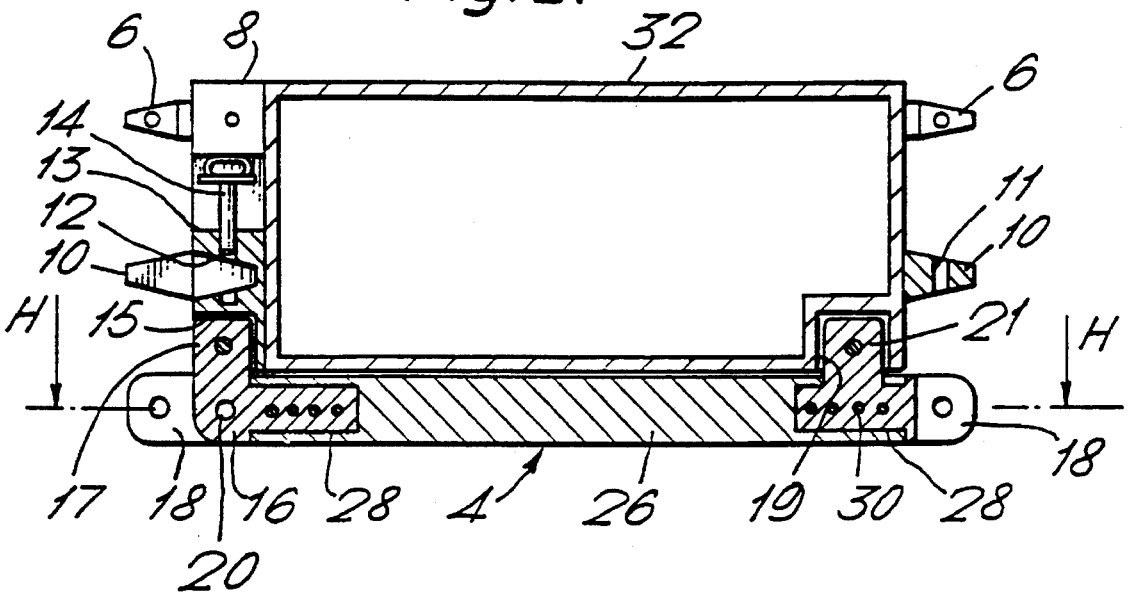
FIG. 2 shows a vertical section on the line AA through the module shown in FIG. 1.
Figure 3:
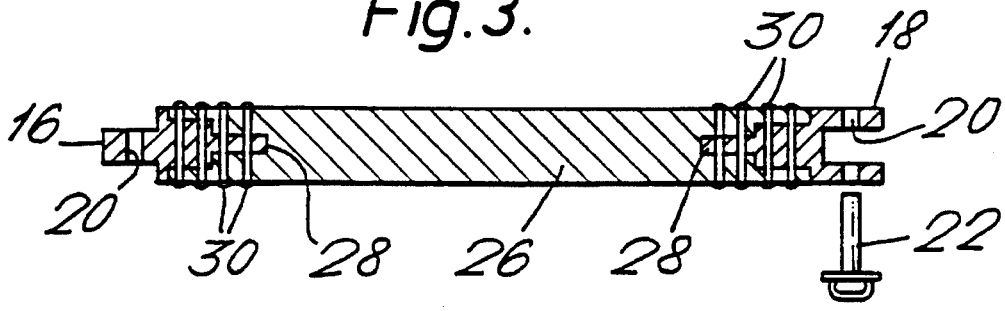
FIG. 3 shows a horizontal section on the line HH of the link member shown in FIG. 2.

Two modules can be connected together by confronting an end 23 of a first module with an end 23 of a second module. The spigot 6 and lug 10 of each confronting face may then be engaged with the socket 8 and first slot 12 respectively of the other confronting face. The captive pins 14 (one on each module) may then be lowered into their respective housing blocks 13 in order to lock both lugs 10 in place and a socket pin 37 may be slid horizontally into each socket 8 (one on each module) in order to lock the spigots 6 in place. When the bridge is to be used in the dry span role the links 4 are left in place as shown in FIGS. 1 and 2 and link connection pins 22 are inserted into engaged pairs of connecting members 16 and 18 in order to connect the link members on each side of the bridge together. When however the modules are to be used to construct a floating bridge or a ferry the link members 4 may be removed in order to remove redundant weight. The link member at each end of a module may be removed by extracting the link securing pins 24 which secure it in place and lowering it away from the module. By adding more modules on in a similar manner a bridge or ferry structure with the link members present or absent as required can be built up.

Figure 4:
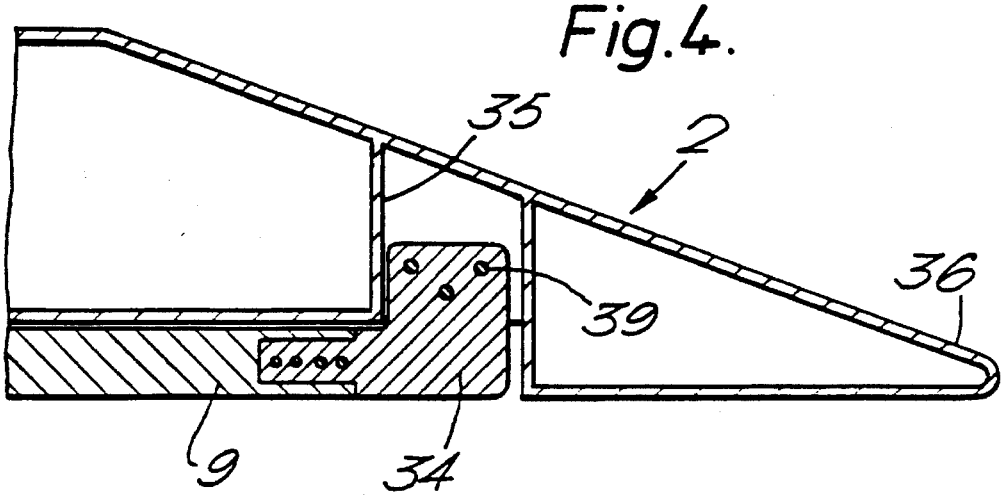
FIG. 4 shows a partial vertical cross section of a ramp module.
Figure 5:
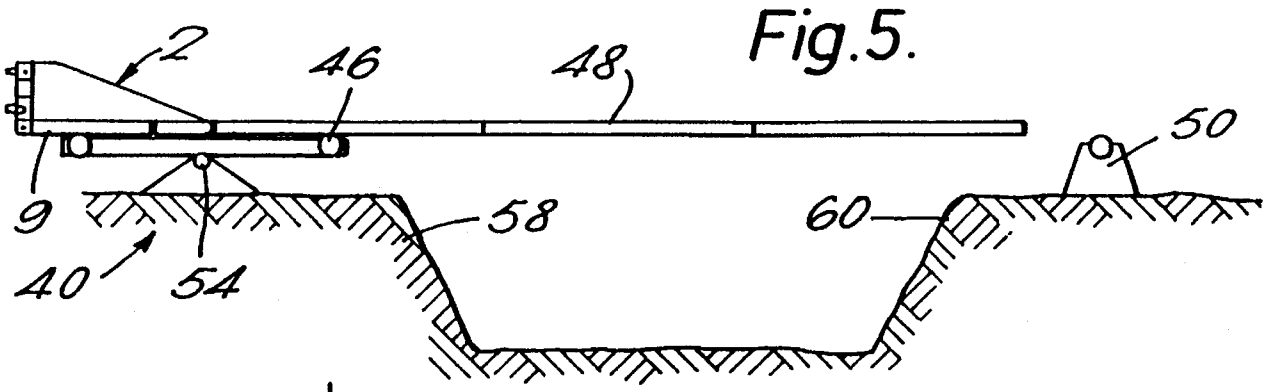
FIGS. 5 to 8 show the sequence involved in launching a bridge constructed according to the second aspect of the invention.
Figure 6:
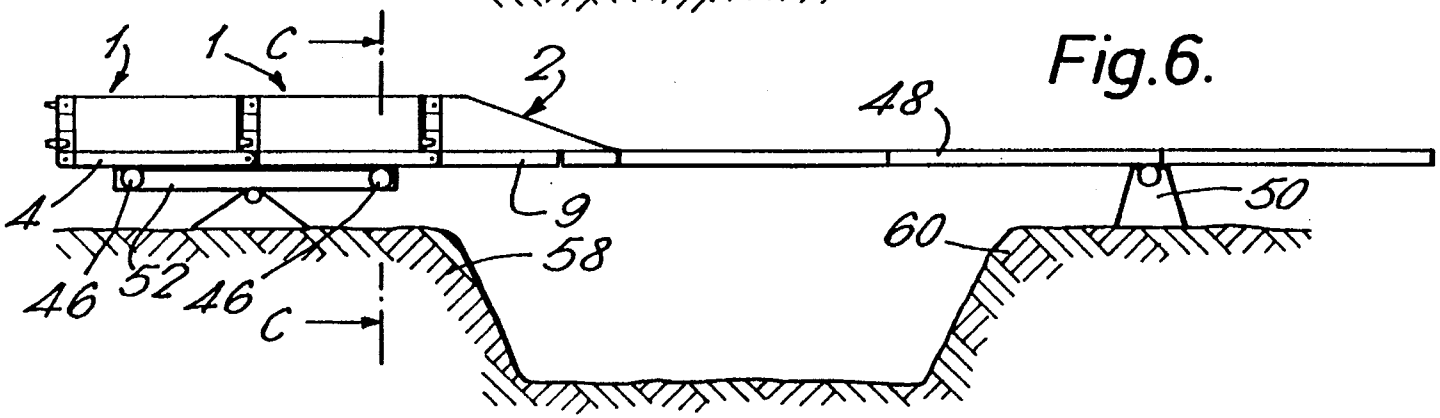

A bridge constructed using the modules described above will normally be provided with a ramp module 2 at each end. FIG. 4 shows a part vertical cross section of a ramp module through the ramp link at one end of the module. The left hand side of the ramp module seen in FIG. 4 includes a spigot, socket, lug and housing block arrangement the same as that provided on the left hand side of a standard module shown in FIGS. 1 and 2 and has been omitted from FIG. 4. The ramp module tapers towards a ramp toe 36 in order to facilitate the passage of vehicles on and off them bridge or ferry. At each end of the ramp module a ramp link member 9 is provided. As there will not normally be a necessity to connect the toe end of the ramp module to another module each ramp link member 9 does not project beyond the toe 36. Ramp modules without links can be coupled together in overlapping relationship in order to form a large floating bridge from a number of smaller floating bridge or ferry assemblies. The end of the ramp link member nearest to the toe 36 is provided with a load distribution plate 34 with retaining pin holes 39. The plate 34 is engageable with a recess 35 in the ramp module. The plate 34 is used firstly to hold the ramp link member 9 in place underneath the ramp module to aid construction of a bridge and secondly to transfer tensile forces from interconnected link members in a loaded dry span bridge to the remainder of the bridge structure.

A method of launching a dry span bridge constructed from the modules described above including link members will now be described with reference to FIGS. 5 to 9.

A support structure 40 is made up on the near bank 58 and a probe support 50 is located on the far bank 60. The support structure 40 (see FIGS. 5 and 9) comprises a frame pivot 54 supporting a roller frame 52. A roller shaft 45 extends across each end of the roller frame 52 and extends outside the roller frame in order to support a roller 46 on each side of the frame. The two rollers on one side of the frame are spaced from the two rollers on the other side of the frame by the distance between the link members of a module. A probe roller 56 is positioned centrally on each roller shaft 45.

Figure 7:
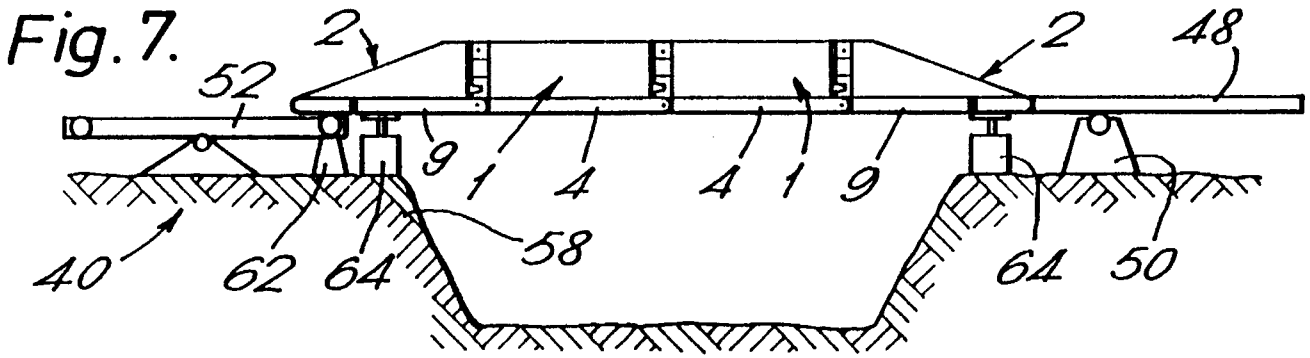
Figure 8:
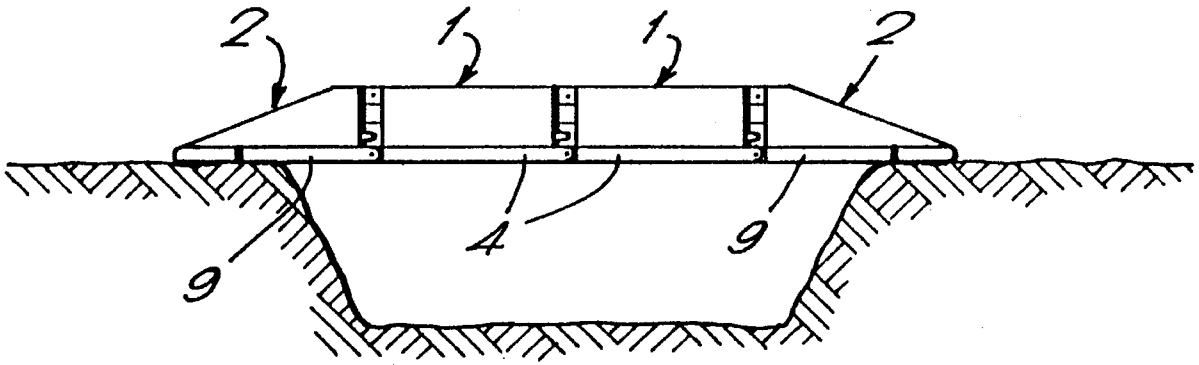
Figure 9:
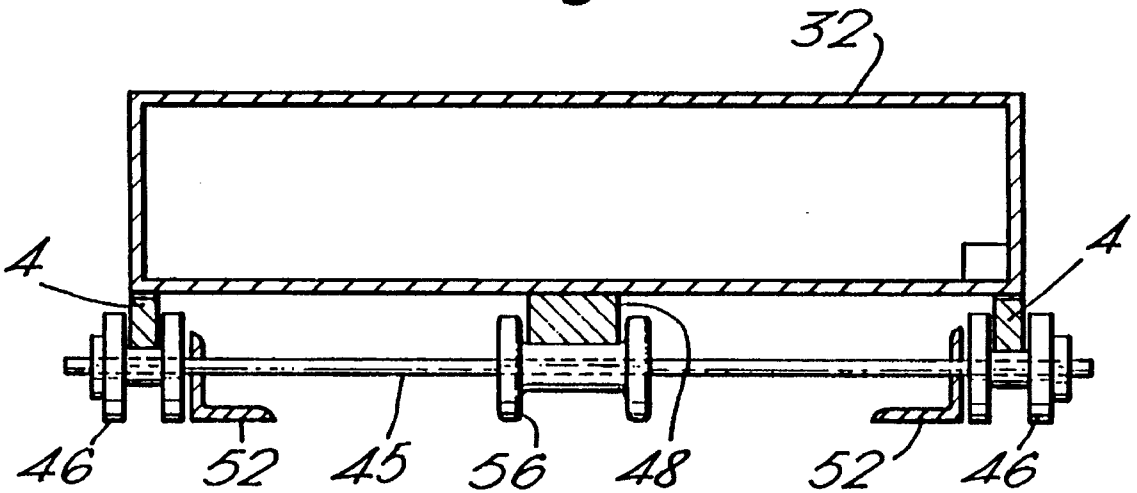
FIG. 9 shows a vertical section on the line CC through the bridge and part of the support structure shown in FIG. 6.

A light weight probe 48 made up from sections is fabricated. The length of the probe 48 is selected to suit the width of the gap that is to be bridged. This assembly is then rolled towards the far bank centrally over the roller frame 52 supported on probe rollers 56 at each end of the roller frame. As more probe is cantilevered over the gap to be bridged bridge modules are connected to the probe in order to balance the structure over the frame pivot 54. Firstly a ramp module 2 is connected to the probe 48. Thereafter standard modules 1 are connected as described above until a sufficient number have been added to form a bridge of adequate length. The modules are supported on the roller frame 52 by means of the link members 4 engaging the rollers 46. As the modules are joined on the bridge and probe are rolled further towards the far bank 60 and the probe 48 is dismantled section by section as it passes over the probe support 50 and becomes redundant. When the bridge is of a sufficient length a second ramp module 2 is connected as shown in FIG. 7 and a supplementary support 62 is placed under the end of the frame 52 nearest to the far bank. Jacks 64 are then used to jack up each end of the bridge in order to allow the remaining probe section 48 to be removed from the bridge and the support structure 40 and probe support 50 to be removed. The bridge may then be lowered to the ground for use. Removal of the bridge is carried out by reversing the procedure described above.

When constructing a bridge for use as a ferry or for use as a floating bridge the link members can be omitted as mentioned above. Construction for such use can conveniently be effected by joining the modules together while they are floating in the water.

We claim:

1. Bridge module comprising:

a buoyant structure with buoyancy sufficient to support a load on said bridge module when said module is floated in water;

at least one end of said buoyant structure having module interconnection means for connecting the module end to an end of an adjacent module so as to form a bridge comprising a plurality of said modules, said bridge module further comprising at least one removable link member with link connection means and link securing means, each of said at least one link member being releasably securable to the buoyant structure by said link securing means and being longitudinally connectable to a link member of an adjacent module by said link connection means, said link members carrying tensile forces experienced by a bridge comprising a plurality of said modules.

2. A module as claimed in claim 1 wherein the or each link member is connectable to the module adjacent a lower surface of the module.

3. A module as claimed in claim 1 wherein said at least one link, member comprises two link members, one link member provided adjacent each side of the buoyant structure.

4. A module as claimed in claim 1 wherein interconnection of two modules aligns the link connection means of the link members of the interconnected modules.

5. A module as claimed in claim 1 wherein each link member has differing first and second ends constituting the link connection means the first end of a link member being complimentarily connectable to the second end of a similar link member.

6. A module as claimed in claim 1 wherein the link connection means is configured so that longitudinal connection of said at least one link member on said module with at least one link member on said adjacent module may be effected with a single pin.

7. A module as claimed in claim 6 wherein the link connection means is configured so that connection may be effected by horizontal insertion of a pin from a side of the module.

8. A module as claimed in claim 1 wherein the securing means for releasably securing the or each link member to the buoyant structure comprises a pinned connection.

9. A module as claimed in claim 1 wherein the link securing means includes two upstand members for engagement with the buoyant structure.

10. A module as claimed in claim 9 wherein the upstand members are accommodated in recesses in the buoyant structure.

11. A module as claimed in claim 9 wherein the buoyant structure includes a block which constitutes part of the module interconnection means and also has a recess for accommodating one of said two upstand members.

12. A module as claimed in claim 1 wherein the modulus of elasticity of material constituting a majority of the or each link member is more than twice that of material constituting a majority of the buoyant structure.

13. A module as claimed in claim 1 wherein the or each link member is made from an alloy containing ferrous material or from a fibre reinforced plastics material.

14. A module as claimed in claim 1 wherein a majority of the buoyant structure is made of aluminum or an alloy thereof.

15. A module as claimed in claim 1 wherein the link connection means is made of metal.

16. A module as claimed in claim 1 wherein said at least one link member projects below a lower surface of the buoyant structure and has a substantially projection free under side.

17. A module as claimed in claim 1 wherein two opposing ends of the module each have interconnection means for connecting the module to an adjacent module.

18. A bridge module as claimed in claim 1 having a link member which is connected at a first end to the buoyant structure for transmission of link tension forces to the buoyant; structure and is longitudinally connectable to a link member of an adjacent module at a second end.

19. A modular bridge comprising a plurality of modules as claimed in claim 1 interconnected with the link members of adjacent modules connected via the link connection means.

20. A method of launching the bridge claimed in claim 19 comprising the step of rolling the bridge over a support structure configured to support the bridge by means of the link members.

21. A method of launching a modular bridge, said modular bridge comprising a plurality of modules wherein each module comprises a buoyant structure with at least one end having module interconnection means for connecting the module end to end to an adjacent module so as to form the modular bridge, the modules further comprising at least one link member with link connection means and link securing means, each link member releasably securable to the buoyant structure by the link securing means, connectable to an adjacent module adjacent and longitudinally connectable to a link member of an adjacent module via the link connection means to support tensile forces experienced by the modular bridge, wherein the assembled modular bridge comprises a plurality of such modules interconnected with the link members of adjacent modules connected via the link connection means, said method of launching comprises the steps off (a) assembling a support structure on a near bank of a gap to be bridged and a probe support on a far bank of said gap, the support structure comprising a roller frame and a frame pivot, said roller frame being supported by the frame pivot and having a roller shaft extending across each end wherein each roller shaft supports a central probe roller and extends outside of the frame to support an outside roller on each side of the frame, the two outside rollers on one side of the frame being spaced from the two outside rollers on the other side of the frame by the distance between the link modules;

(b) assembling a probe comprising of a plurality of probe sections to a length at least as great as the width of the gap;

(c) rolling the probe out toward said far bank centrally over the roller frame, supported by the central probe rollers at each end of the roller frame;

(d) connecting bridge modules to the probe to balance the structure over the frame pivot as more probe is cantilevered over the gap, firstly connecting a ramp module and standard bridge modules thereafter whilst disassembling the probe as it passes the probe support on the far bank;

(e) connecting bridge modules until the bridge is of a sufficient length to bridge the gap and then connecting a final ramp section to form a completed bridge;

(f) connecting a supplèmentary bridge support to the completed bridge on the near bank;

(g) attaching jacks to the completed bridge at both the near and far banks and raising the bridge to remove the remaining probe sections and the bridge support and probe support; and (h) lowering the bridge to the ground.

22. Bridge module comprising:

a buoyant structure with buoyancy sufficient to support a load on said bridge module when said module is floated in water;

at least one end of said buoyant structure having a module interconnection for connecting the module end to an end of an adjacent module so as to form a bridge comprising a plurality of said modules, said bridge module further comprising at least one removable link member with a link connection and link securer, each of said at least one link member being releasably securable to the buoyant structure by said link securer and being longitudinally connectable to a link member of an adjacent module by said link connection, said link members carrying tensile forces experienced by a bridge comprising a plurality of said modules.

* * * * *